United States Patent [19]

Segerström

[11] 4,242,067

[45] Dec. 30, 1980

[54] HYDRAULIC SCREW MACHINE WITH BALANCE PLUNGER

[75] Inventor: Lars H. Segerström, Skärholmen, Sweden

[73] Assignee: Imo-Industri Aktiebolag, Stockholm, Sweden

[21] Appl. No.: 941,645

[22] Filed: Sep. 12, 1978

[30] Foreign Application Priority Data

Sep. 15, 1977 [SE] Sweden ..... 7710357

[51] Int. Cl.³ ..... F03C 2/08; F04C 2/16; F04C 15/00

[52] U.S. Cl. ..... 418/203; 418/197; 29/156.4 R

[58] Field of Search ..... 418/197, 201, 203; 29/156.4 R, 434

[56] References Cited

U.S. PATENT DOCUMENTS

| | | | |
|---|---|---|---|
| 2,321,696 | 6/1943 | Montelius | 418/201 |
| 2,693,763 | 11/1954 | Sennet | 418/197 |
| 4,028,025 | 6/1977 | Lonnebring | 418/203 |

FOREIGN PATENT DOCUMENTS

| | | | |
|---|---|---|---|
| 667108 | 11/1938 | Fed. Rep. of Germany | 418/2 03 |
| 168718 | 9/1959 | Sweden | 418/201 |

*Primary Examiner*—John J. Vrablik

*Attorney, Agent, or Firm*—Schuyler, Banner, Birch, McKie & Beckett

[57] ABSTRACT

A hydraulic screw machine comprises a driving screw and at least one impeller screw with a balance plunger at its end. The thread of the impeller screw is complete with full depth all the way to the balance plunger. The length of the plunger is less than the width in the axial direction of the thread groove in the driving screw. The balance plunger is mounted on an axial pin on the end of the impeller screw.

4 Claims, 1 Drawing Figure

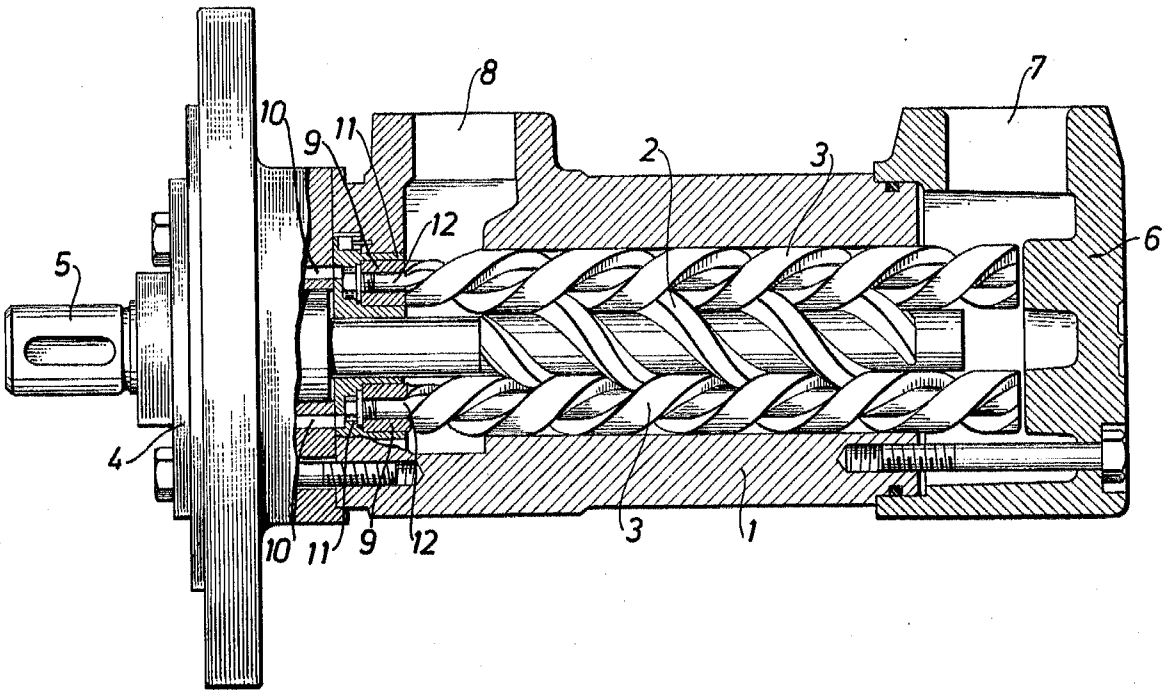
6
7
3
2
8
12
11
9
10
5
4
1
3
12
9
11
10

HYDRAULIC SCREW MACHINE WITH BALANCE PLUNGER

The present invention relates to a hydraulic screw machine (pump or motor) having a driving screw and at least one impeller screw with a balance plunger at its end. When assembling screw pumps or motors of this kind with balance plungers at the high pressure side of the machine the problem is that the whole screw assembly has to be introduced into the casing from the high pressure side as a unit, which is difficult and time-consuming.

This is due to the fact that when the thread groove of the impeller screw is being cut by means of a side-milling cutter or a warm hobber, an incomplete groove end with a progressively increasing root diameter is obtained when the cutter withdraws from the screw blank at the balance plunger end. If the balance plunger of the impeller screw is arranged at the pressure side of the pump, the insertion of the impeller screw during machine assembly from the feeding side is impossible, as the crest of the driving screw thread will interfere with the root of the incomplete thread groove of the impeller screw at the balance plunger end. If, however, the balance plungers of the impeller screws are arranged at the feeding side, this problem does not exist inasmuch as the incomplete thread groove ends at the plunger are of no consequence, as the end of the driving screw may be shaped in a suitable way and the incomplete thread groove ends at the pressure side of the impeller screws may be cut away to allow the impeller screws to be inserted without impediment from the feeding side.

The object of the invention is to make possible an installation of the separate screw one after another, first the driving screw from the high pressure side and then the impeller screws from the low pressure side. This is fulfilled in the screw machine according to the invention in that the thread of every impeller screw is complete with full depth all the way to the balance plunger and in that the length of that plunger is less than the width in the axial direction of the thread groove in the driving screw.

The invention will be closer described with reference to the enclosed drawing which shows a screw pump according to the invention in a longitudinal sectional view.

In a casing 1 a screw assembly is arranged, comprising a driving screw 2 and two impeller screws 3. The shaft of the driving screw is mounted in a stuffing box 4 and extends therefrom with a driving pin 5. The low pressure side of the casing is closed by means of an end wall 6 which is provided with the inlet 7 of the pump. The outlet 8 of the pump is provided in the high pressure side. When the machine is used as a motor the inlet is provided in the high pressure side instead and the outlet in the low pressure side.

Each impeller screw 3 comprises a balance plunger 9 which is influenced by the pressure of the low pressure side via borings 10 and an axial boring through the driving screw and is displaceable in a cylinder 11. The purpose of the balance plungers is to balance the forces acting against the screw assembly from the high pressure side. The diameter of the balance plunger is greater than the root diameter of the impeller screws, as illustrated in the drawing.

In order to facilitate the assembly of the machine—which previously has been carried out so that the whole screw assembly with the cylinders 11 put on the balance plungers 9 has been inserted as a unit from the high pressure side—the impeller screws have been designed in the following manner. The thread has been made complete with full depth all the way to the balance plunger. This has been facilitated in that the plunger has not been made in one piece with the screw but been mounted on an axial pin 12 on the end of the impeller screw. Furthermore, the length of the balance plunger has been made smaller than the width in axial direction of the thread groove in the driving screw. Through these measures the impeller screws can be separately screwed on from the low pressure side after the driving screw and the cylinders 11 have been inserted from the high pressure side which facilitates the assembly considerably.

I claim:

1. A hydraulic screw machine comprising:

a housing having a fluid inlet adjacent one end thereof and a fluid outlet adjacent the opposite end thereof;

a driving screw disposed within said housing between said inlet end and said outlet end and journalled for rotation at one end of said housing;

at least one impeller screw intermeshing with said driving screw within said housing and journalled for rotation at the same end of said housing as said driving screw is journalled; and a balance plunger on the journalled end of said impeller screw for balancing the axial pressure forces acting on said impeller screw, the diameter of said balance plunger being greater than the root diameter of said impeller screw, the thread of said impeller screw extending with full depth all the way to said balance plunger, and the length of said plunger being less than the axial width of the thread groove in said driving screw so that said plunger can pass through said thread groove when said impeller screw is inserted into said housing from the end opposite the end at which said screws are journalled during assembly of the machine.

2. A hydraulic screw machine according to claim 1 wherein said balance plunger is mounted on an axial pin on the end of said impeller screw.

3. A hydraulic screw machine comprising:

a housing having a high pressure side and an opposed low pressure side;

a driving screw disposed within said housing between said high pressure side and said low pressure side;

At least one impeller screw intermeshing with said driving screw within said housing; and a balance plunger on the end of said impeller screw at said high pressure side for balancing the axial pressure forces acting on said impeller screw, the diameter of said balance plunger being greater than the root diameter of said impeller screw, the thread of said impeller screw extending with full depth all the way to said balance plunger, and the length of said plunger being less than the axial width of the thread groove in said driving screw so that said plunger can pass through said thread groove when said impeller screw is inserted into said housing from said low pressure side during assembly of the machine.

4. A hydraulic screw machine according to claim 3, characterized in that the balance plunger is mounted on an axial pin on the end of the impeller screw.

* * * * *